US010804663B2

(12) United States Patent
Cheng

(10) Patent No.: US 10,804,663 B2
(45) Date of Patent: Oct. 13, 2020

(54) SWIVEL PIVOT CONNECTOR ADAPTER

(71) Applicant: Steve Cheng, Emerald Hills, CA (US)

(72) Inventor: Steve Cheng, Emerald Hills, CA (US)

(73) Assignee: Steve Cheng, Emerald Hills, CA (US)

( * ) Notice: Subject to any disclaimer, the term of this patent is extended or adjusted under 35 U.S.C. 154(b) by 0 days.

(21) Appl. No.: 16/270,242

(22) Filed: Feb. 7, 2019

(65) Prior Publication Data

US 2020/0259303 A1 Aug. 13, 2020

(51) Int. Cl.

| | |
|---|---|
| ***H01R 13/58*** | (2006.01) |
| ***H01R 35/04*** | (2006.01) |
| ***H01R 13/56*** | (2006.01) |
| ***H01R 24/62*** | (2011.01) |

(52) U.S. Cl.

CPC ..... *H01R 35/04* (2013.01); *H01R 13/56* (2013.01); *H01R 13/5841* (2013.01); *H01R 24/62* (2013.01)

(58) Field of Classification Search

CPC ..... H01R 35/04; H01R 39/00; H01R 39/64; H01R 13/582; H01R 13/5829; H01R 13/5841; H01R 24/62

USPC ..... 439/6, 10, 13, 131

See application file for complete search history.

(56) References Cited

U.S. PATENT DOCUMENTS 2,652,546 A * 9/1953 Christner ..... H01R 35/04 439/8
4,719,314 A 1/1988 Nothnagel et al.
4,731,030 A * 3/1988 Johnston ..... F16M 11/041 439/10
5,112,153 A * 5/1992 Gunn ..... F16C 11/0633 403/69
5,735,707 A 4/1998 O'Groske et al.
6,062,884 A * 5/2000 Messimer ..... H01R 31/06 439/131
6,116,958 A 9/2000 Reichle
6,220,889 B1 * 4/2001 Ely ..... H01R 13/5841 439/310
6,508,335 B2 * 1/2003 Zinanti ..... A63C 17/01 188/1.12
6,537,106 B1 * 3/2003 Follingstad ..... H01R 13/518 439/534
6,651,890 B2 * 11/2003 Byun ..... A47F 9/046 235/462.43
6,814,580 B2 11/2004 Li et al.
7,094,091 B2 8/2006 Grzegorzewska et al.
7,186,133 B1 3/2007 Szczesny
7,435,090 B1 10/2008 Schriefer et al.
7,494,039 B2 * 2/2009 Racenet ..... A61B 17/07207 227/180.1
7,527,500 B2 5/2009 Montena
7,695,292 B2 * 4/2010 Lee ..... G06F 13/409 439/110

(Continued)

*Primary Examiner* — Edwin A. Leon
*Assistant Examiner* — Milagros Jeancharles
(74) *Attorney, Agent, or Firm* — Kramer Amado, P.C.

(57) ABSTRACT

A connector adapter including a pivot connector frame, a clamping shroud configured to fit through the pivot connector frame, a connector case disposed within the clamping shroud, a sliding sheath to which the connector case is connected, and a bulkhead adapter cavity formed within the connector case, wherein the connector case is configured for rotatable movement and slidable movement within the pivot connector frame.

19 Claims, 11 Drawing Sheets

(56) References Cited

U.S. PATENT DOCUMENTS

| | | | | |
|---|---|---|---|---|
| 7,824,185 | B2 * | 11/2010 | Chien | H04N 5/76 439/11 |
| 8,033,867 | B1 * | 10/2011 | Kessler | H01R 25/003 439/652 |
| 8,226,419 | B2 | 7/2012 | Fonzo | |
| 8,821,093 | B2 * | 9/2014 | Kratzer | F16B 37/14 411/204 |
| 8,894,420 | B2 | 11/2014 | Schichl et al. | |
| 8,968,023 | B1 | 3/2015 | Walters et al. | |
| 9,158,074 | B2 | 10/2015 | Anderson et al. | |
| 9,325,134 | B2 | 4/2016 | Lopez et al. | |
| 9,800,031 | B2 | 10/2017 | Irons et al. | |
| 10,033,144 | B1 * | 7/2018 | Patterson | H01R 25/006 |
| 2008/0090432 | A1 * | 4/2008 | Patterson | H01R 25/142 439/121 |
| 2008/0286985 | A1 | 11/2008 | Huang | |
| 2011/0059636 | A1 * | 3/2011 | Ni | G06K 19/041 439/131 |
| 2012/0156937 | A1 * | 6/2012 | Almouli | H01R 25/142 439/640 |
| 2013/0052840 | A1 * | 2/2013 | Wang | H01R 25/142 439/32 |
| 2013/0084725 | A1 * | 4/2013 | Liao | H01R 31/06 439/170 |
| 2017/0160493 | A1 | 6/2017 | Lin et al. | |
| 2018/0372041 | A1 * | 12/2018 | Hagmann | H01R 13/207 |
| 2019/0118738 | A1 * | 4/2019 | Ushiyama | B62D 1/04 |

* cited by examiner

SWIVEL PIVOT CONNECTOR ADAPTER

TECHNICAL FIELD

Embodiments disclosed herein relate generally to a cable connector adapter and more specifically to a cable connector adapter configured to be used with all types of communications cables and connectable bulkhead adapters.

SUMMARY

A brief summary of various embodiments is presented below. Some simplifications and omissions may be made in the following summary, which is intended to highlight and introduce some aspects of the various embodiments, but not to limit the scope of the invention. Detailed descriptions of embodiments adequate to allow those of ordinary skill in the art to make and use the inventive concepts will follow in later sections.

Example embodiments include a connector adapter including a pivot connector frame, a clamping shroud configured to fit through the pivot connector frame, a connector case disposed within the clamping shroud, a sliding sheath to which the connector case is connected, and a bulkhead adapter cavity formed within the connector case, wherein the connector case is configured for rotatable movement and slidable movement within the pivot connector frame.

The connector case may rotate within the clamping shroud.

The rotatable movement may be omni-directional movement.

The sliding sheath may be configured to move bi-directionally within the pivot connector frame.

The sliding sheath may have stoppers at ends thereof to prevent over rotation of the sliding sheath. The sliding sheath may be arc-shaped. The sliding sheath may house a plurality of connector cases.

The rotatable movement and slidable movement may be independent of each other.

Example embodiments also include a connector adapter including a connector frame, a sliding sheath movable in two directions about the connector frame, a connector case mounted within the sliding sheath, and a bulkhead adapter cavity formed within the connector case, the bulkhead adapter cavity configured to receive a connector and cable, wherein the bulkhead adapter cavity is configured to move in at least two directions within the sliding sheath.

One direction of the at least two directions may be bi-directional and a second direction of the at least two directions is rotatable. The second direction may be omni-directional.

The sliding sheath may include stoppers to limit and prevent over rotation of the sliding sheath. The sliding sheath is arc-shaped. The connector adapter may include a shroud to protect the connector case.

The connector frame may have two sides and the shroud extends from either side to protect the connector case. The shroud is adjustable and configured to tighten or loosen a motion cadence of the connector case.

The connector frame may include panel secure tabs configured to attach to a panel.

BRIEF DESCRIPTION OF THE DRAWINGS

Additional objects and features of the invention will be more readily apparent from the following detailed description and appended claims when taken in conjunction with the drawings. Although several embodiments are illustrated and described, like reference numerals identify like parts in each of the figures, in which:

DETAILED DESCRIPTION

Figure 1A:
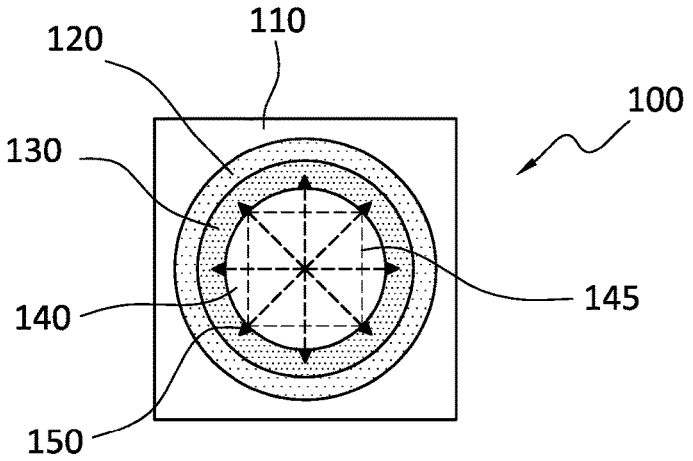
FIG. 1A illustrates a front view of an omni-directional swivel connector adapter in accordance with example embodiments described herein.

It should be understood that the figures are merely schematic and are not drawn to scale. It should also be understood that the same reference numerals are used throughout the figures to indicate the same or similar parts.

The descriptions and drawings illustrate the principles of various example embodiments. It will thus be appreciated that those skilled in the art will be able to devise various arrangements that, although not explicitly described or shown herein, embody the principles of the invention and are included within its scope. Furthermore, all examples recited herein are principally intended expressly to be for pedagogical purposes to aid the reader in understanding the principles of the invention and the concepts contributed by the inventor(s) to furthering the art and are to be construed as being without limitation to such specifically recited examples and conditions. Additionally, the term, "or," as used herein, refers to a non-exclusive or (i.e., and/or), unless otherwise indicated (e.g., "or else" or "or in the alternative"). Also, the various embodiments described herein are not necessarily mutually exclusive, as some embodiments can be combined with one or more other embodiments to form new embodiments. Descriptors such as "first," "second," "third," etc., are not meant to limit the order of elements discussed, are used to distinguish one element from the next, and are generally interchangeable. Values such as maximum or minimum may be predetermined and set to different values based on the application.

Embodiments described herein include a cabling connector hinge mechanism that is configured to rotate and/or pivot, providing movement and flexibility at a cable connection junction within an infrastructure panel. This movement and flexibility may allow a high degree of cable bend angle while at the same time reducing cable bend and strain.

Standard telecommunications cables interconnect into infrastructure patch panels in a limited way. They are inserted directly perpendicular into the patch panel using a rigid foundation that limits the angle or bend degree of the cable as it is dressed out to the supporting infrastructure or connected device. In some cases this limitation in bend degree can leave cables susceptible to an inordinate amount of cable bend strain causing signal degradation or failure.

Example embodiments include a flexible swivel pivoting hinge connector adapter that addresses and resolves these and other issues while providing new features and attributes that are configured to enhance connectivity performance, efficiency, flexibility, and capacity.

FIG. 1A illustrates a front view of an omni-directional swivel connector adapter 100 in accordance with example embodiments described herein. The omni-directional swivel connector adapter 100 includes a pivot connector frame 110 that may attach to a patch panel or the like (not illustrated). The pivot connector frame 110 may be called a connector frame. A clamping shroud 120 may provide a covering for connection elements that attach to the pivot connector frame. The clamping shroud 120 may be mounted within the pivot connector frame 110. The clamping shroud 120 may receive a connector case 130. The connector case 130 may be a pivoting orb or sphere shape having a hole to receive an external connector. The shape of the connector case 130 may be used to allow omni-directional rotation along omni-directional lines 150 of a cable and cable connection. The connector case 130 may be said to pivot, rotate, or swivel within the pivot connector frame 110. Rotation in this manner may be known as omni rotation. The omni-directional swivel connector adapter 100 may use the clamping shroud 120 to hold and support the connector case 130. The connector case 130 is movable and tunable to different cable orientations in a cabling environment. Within the connector case 130 may be a connector bulkhead adapter cavity 140. The connector bulkhead adapter cavity 140 is configured to receive a bulkhead adapter (not illustrated) that attaches to a given cable.

In FIG. 1A, the bulkhead adapter cavity 140 may include a square shaped receiving cavity 145, but embodiments are not limited thereto. Bulkhead adapter cavities 140 may take on various polygonal shapes, or circular shapes, or other shapes known in the art that may receive cable connectors.

The connector case 130 hosts the bulkhead adapter cavity 140 and is shaped and designed to provide the flexible omni-directional motion of cables connected thereto. The bulkhead adapter cavity 140 within the connector case 130 is designed to support a variety of current and future connector bulkhead adapter types that may be used to couple to a cable connector plug end.

Figure 1B:
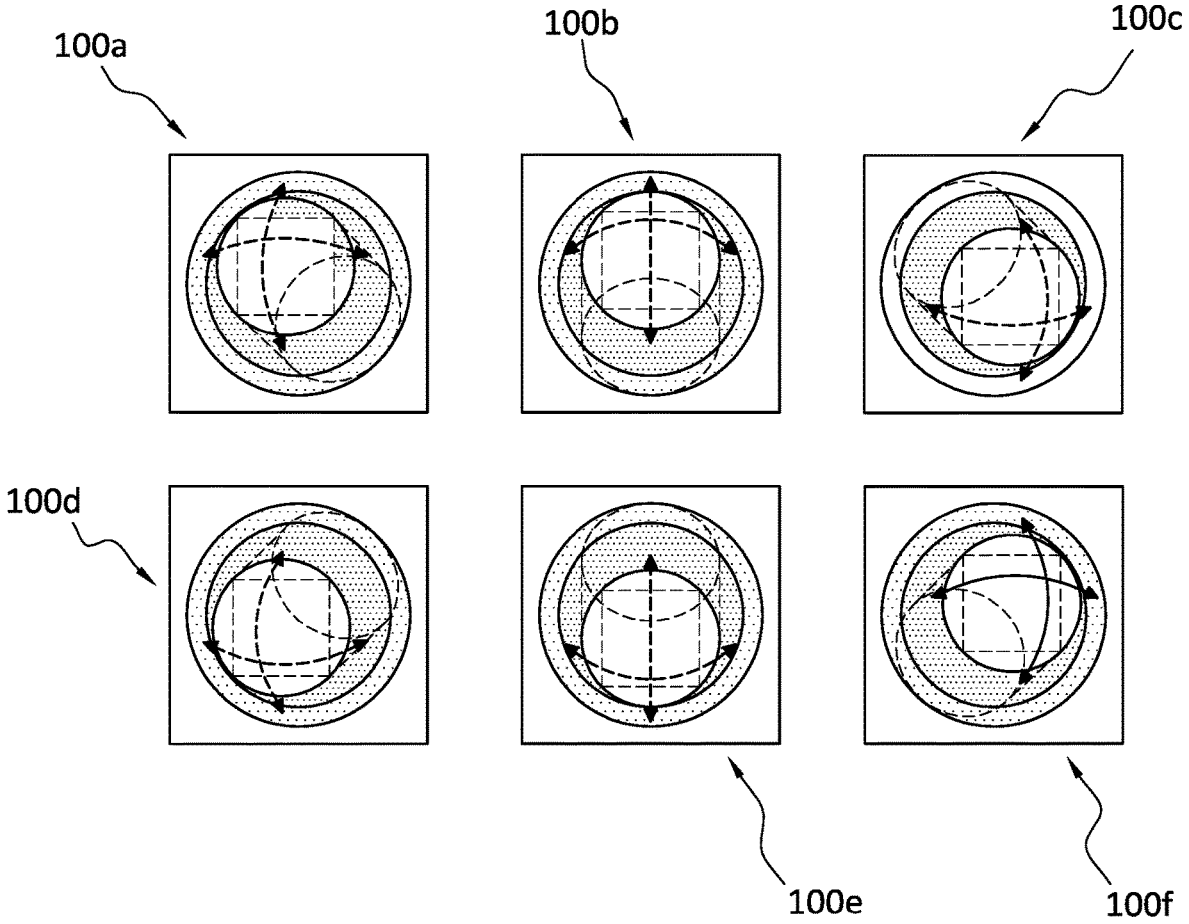
FIG. 1B illustrates rotated front views of the omni-directional swivel connector adapter in accordance with FIG. 1A.

FIG. 1B illustrates rotated front views of the omni-directional swivel connector adapter 100 in accordance with FIG. 1A. Sub-FIG. 100*a* may represent an upward and left orientation. Sub-FIG. 100*b* may represent an upward and straight orientation. Sub-FIG. 100*c* may represent a downward and right orientation. Sub-FIG. 100*d* may represent a downward and left orientation. Sub-FIG. 100*e* may represent a downward and straight orientation. Sub-FIG. 100*f* may represent an upward and right orientation. These orientations represent some examples of how a connector and cable may connect to a patch panel according to example embodiments. Many intermediate orientations are also possible. The described and illustrated versatile and various connection schemes are configured to limit a bending stress of cables and connectors that has not been available previously.

Figure 1C:
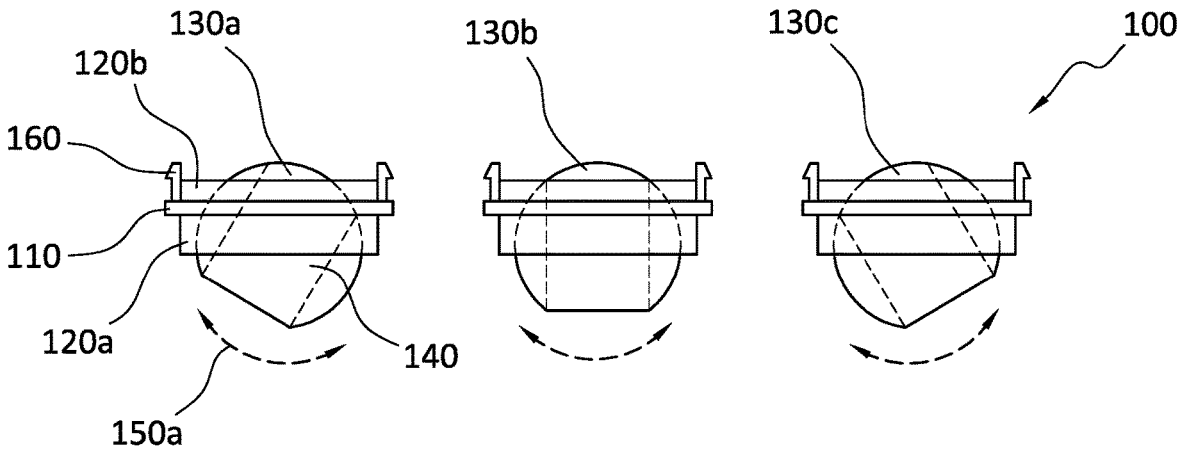
FIG. 1C illustrates top views of the omni-directional swivel connector adapter in accordance with FIG. 1A.

FIG. 1C illustrates top views of the omni-directional swivel connector adapter 100 in accordance with FIG. 1A. FIG. 1C illustrates three rotated orientations 130*a*, 130*b*, and 130*c* of the connector case 130 along rotational line 150*a*, but example embodiments are not limited thereto. The connector case 130 may be tuned to different positions between or outside of the illustrated examples. The connector case 130 may be received within the clamping shroud 120. The clamping shroud 120 may have two portions, a front section 120*a* and a rear section 120*b*. Both sections 120*a* and 120*b* of the clamping shroud 120 may provide protection of the connector case 130 as it passes into and through the pivot connector frame 110. The clamping shroud portions 120*a* and 120*b* may also protect cable and cable connecting portions within the connector case 130. The clamping shroud front 120*a* and rear 120*b* sections may be adjusted to tighten or loosen a motion cadence of the connector case 130.

Connected to the pivot connector frame 110 is a pair of panel secure tabs 160. The panel secure tabs 160 may be used to secure the pivot connector frame 110 to a patch panel or the like (not illustrated).

Figure 1D:
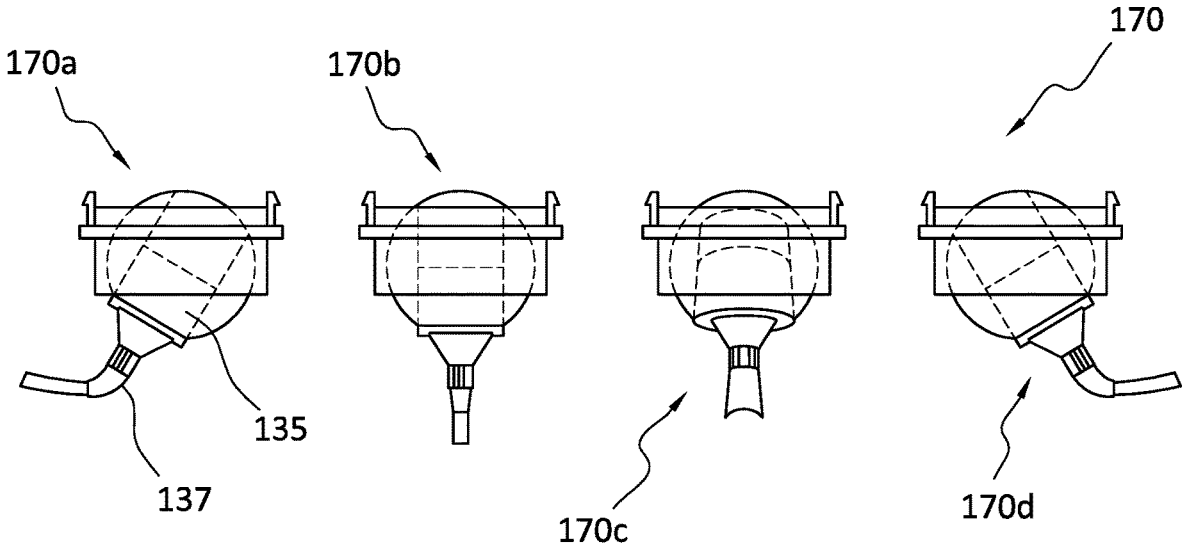
FIG. 1D illustrates connected views of the omni-directional swivel connector adapter in accordance with example embodiments described herein.

FIG. 1D illustrates connected views 170 of the omni-directional swivel connector adapter 100 in accordance with example embodiments described herein. In a connected form, the connector case 130 may receive a bulkhead connector 135 and cable 137. The connector case 130 holding the bulkhead connector 135 and cable 137 may be rotate through various rotational movements 170*a*, 170*b*, 170*c*, and 170*d*, but embodiments are not limited thereto. Rotation and placement of the connector case 130 may be among and between any of the illustrated directions. The bulkhead connector 135 may be connected to cables 137, such as fiber optic cables or other cables known in the art. This ability to rotate in any direction with a movement of the cable 137 decreases tension in cable joints near the bulkhead connector 135, ensuring greater durability and longer life of cables 137 and bulkhead connectors 135 in an overall system.

Figure 2A:
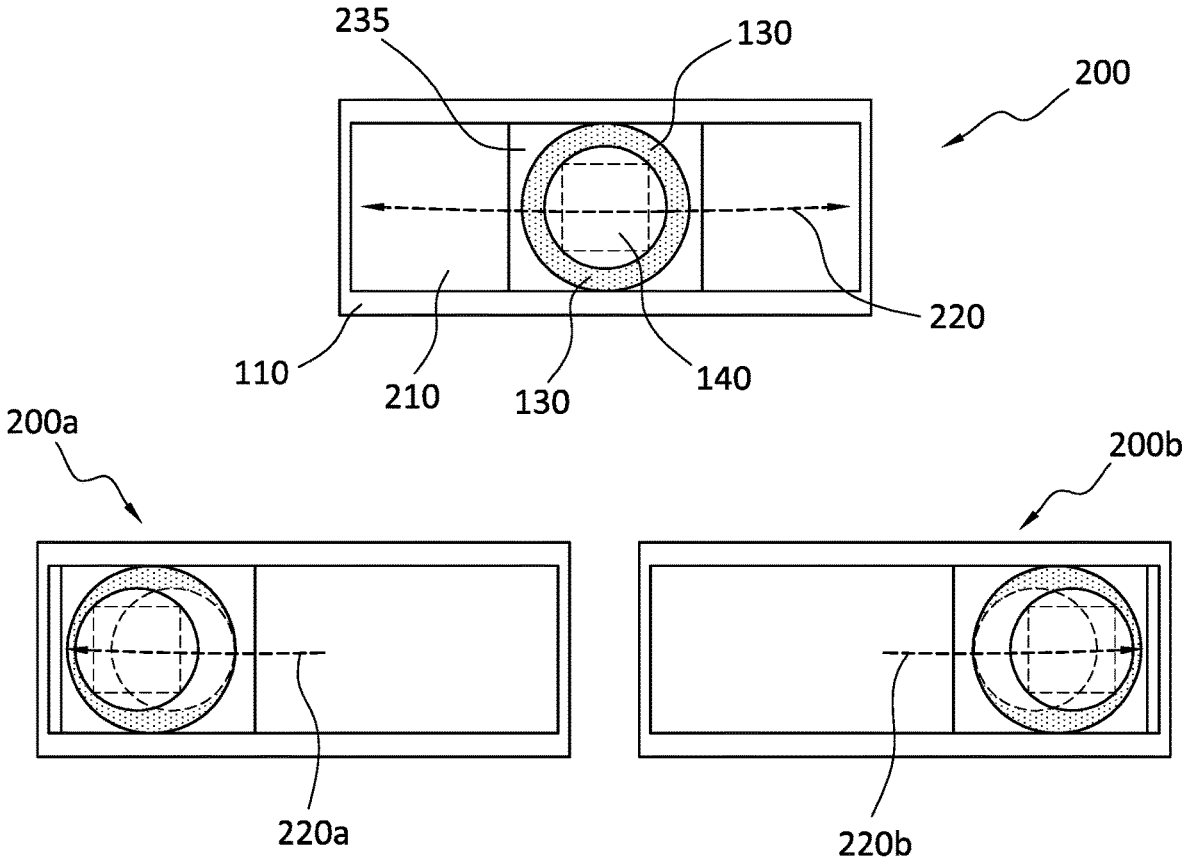
FIG. 2A illustrates front views of a bi-directional sliding sheath swivel connector adapter in accordance with example embodiments described herein.

FIG. 2A illustrates front views of a sliding sheath swivel connector adapter 200 in accordance with example embodiments described herein. A sliding sheath 210 may be an arc-shaped piece that is configured to rotate through a channel or groove within the pivot connector frame 110. The sliding sheath 210 is not limited to an arc-shape. Shapes of the sliding sheath 210 may be used having more rounded or flattened curves than the illustrated arc-shape. Flat surfaces may be used for the sliding sheath 210, or other shapes as may be apparent to those skilled in the art. The sliding sheath swivel connector adapter 200 configuration allows for bi-directional or horizontal movement 220 of the connector case 130 at a connector interface 235. Along with the bi-directional swivel 220, the connector case 130 may rotate left 220*a* and right 220*b* within the connector interface 235 to combine to even greater flexibility of mobility and range of motion of the connector case 130 that may hold a cable and cable connector such as may be used for fiber optics or other mediums. The bi-directional swivel movement and omni-directional movement of the connector case 130 are independent of each other. The connector case 130 may be rotated omni-directionally separate from the bi-directional swivel motion, and the bi-directional swivel motion may be made without rotating the connector case 130 omni-directionally. Alternatively, omni-directional movement and bi-directional swivel action may be performed substantially simultaneously when a cable connector is pushed or pulled in each direction.

Figure 2B:
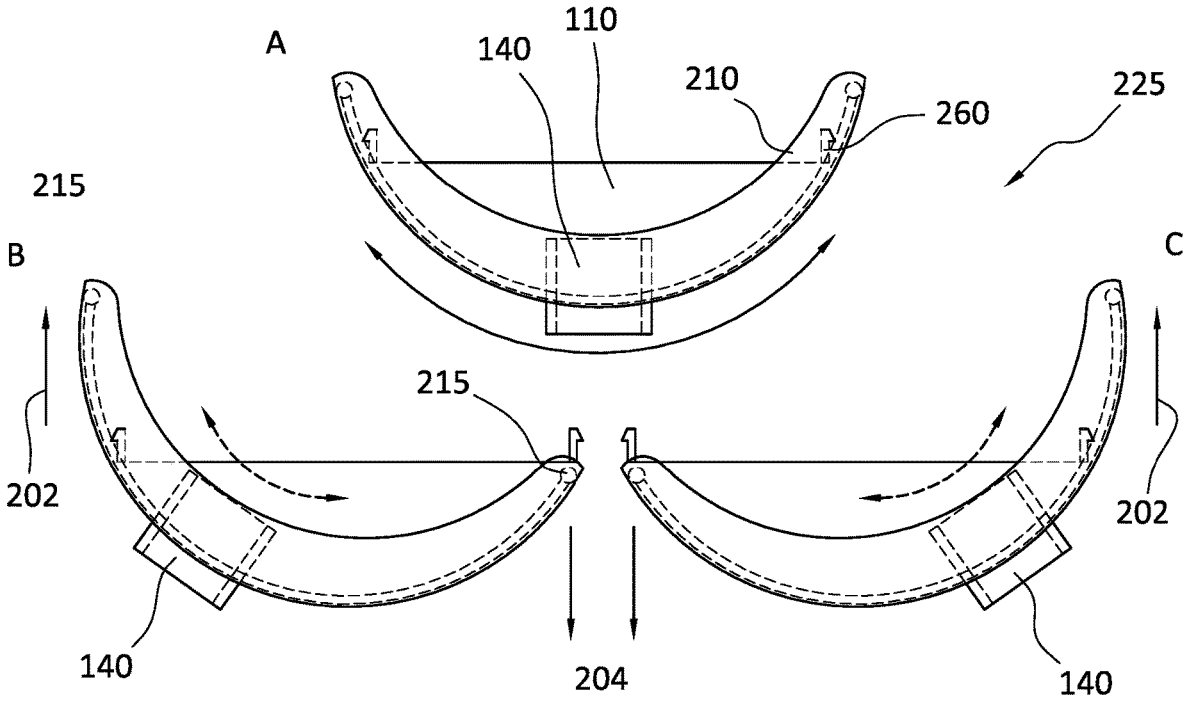
FIG. 2B illustrates top views of the bi-directional sliding sheath swivel connector adapter in accordance with FIG. 2A.

FIG. 2B illustrates top views 225 of the sliding sheath swivel connector adapter 200 in accordance with FIG. 2A. FIG. 2B illustrates panel secure tabs 260 that may be used to secure the pivot connector frame 110 to a patch panel (not illustrated). The top views 225 include default position A and rotated top views B and C in which the sliding sheath 210 has been rotated in a horizontal manner left and right to rotate the bulkhead adapter cavity 140 through a range of motion 220. The bulkhead adapter cavity 140 may remain in a fixed position of the sliding sheath 210 as the sliding sheath 210 roates. Because of a fixed position of the bulkhead adapter cavity 140, when the bulkhead adapter cavity 140 is pulled from side to side, one end of the sliding sheath may rotate in a rearward direction 202, and another end of the sliding sheath may rotate in a forward direction 204. The sliding sheath 210 may include sliding sheath stoppers 215 at ends thereof. The sliding sheath stoppers 215 may interact with impediments within a patch panel (not illustrated) or the pivot connector frame 110 to prevent the sliding sheath 210 from rotating too far within a patch panel.

Figure 2C:
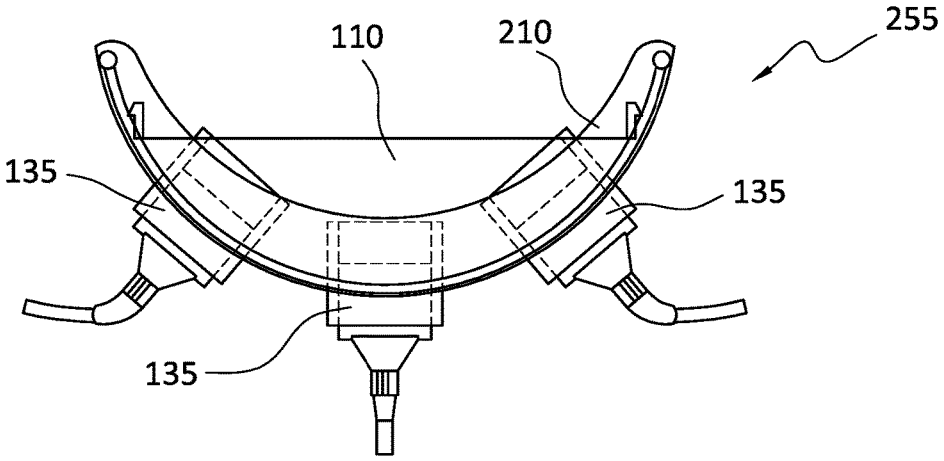
FIG. 2C illustrates a connected view of the bi-directional sliding sheath swivel connector adapters in accordance with example embodiments described herein.

FIG. 2C illustrates a connected view of the sliding sheath connector adapter 200 in accordance with example embodiments described herein. In a connected form, the sliding sheath 210 housing the connector case 130, bulkhead connector 135 and cable 137 may move bi directionally in two directions to increase the connected cables range of motion ensuring greater durability and longer life of cables 137 and bulkhead connectors 135 in an overall system. the connector case 130, bulkhead connector 135 and cable 137

Figure 3A:
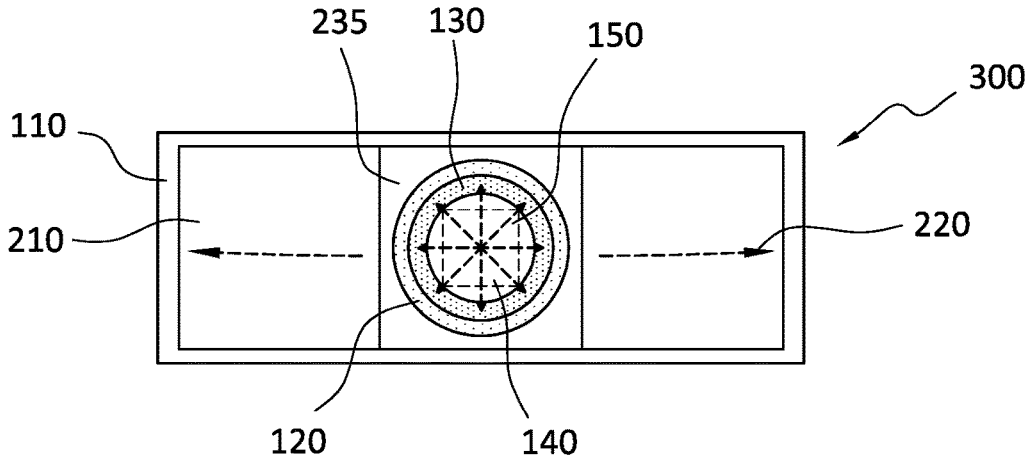
FIG. 3A illustrates a front view of a combination directional swivel connector adapter in accordance with example embodiments described herein.

FIG. 3A illustrates a front view of a combination directional swivel connector adapter 300 in accordance with example embodiments described herein. Similar to example embodiments of FIG. 2, the connector case 130 may be configured to be translated in a horizontal direction 220 on the sliding sheath 210. The combination directional swivel connector adapter 300 allows extended omni-directional mobility along omni-directional lines 150 at the connector interface 235. This extended omni-directional mobility is performed by combining the connector case 130 along with the bi-directional sliding sheath 210.

Figure 4A:
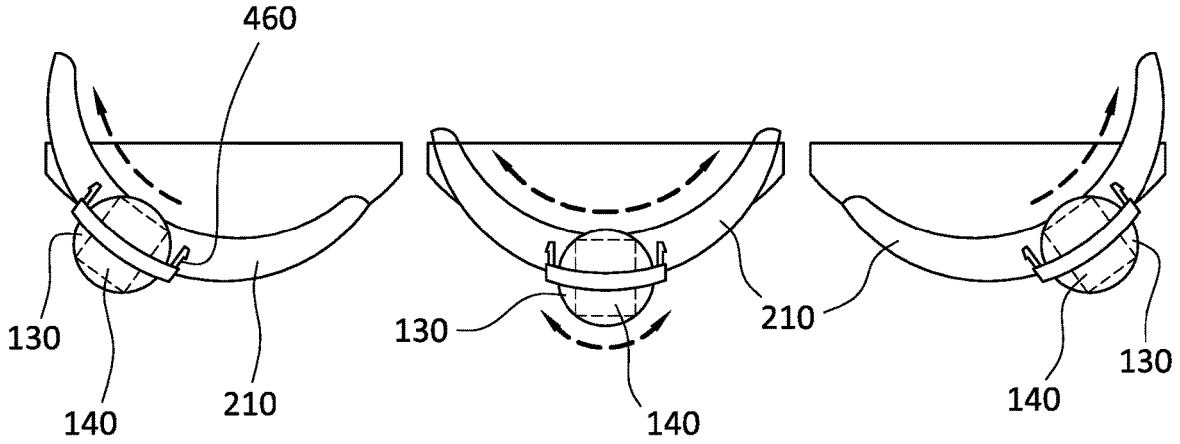
FIG. 4A illustrates top views of left, center, and right sliding sheath directional movements of the combination directional swivel connector adapter in accordance with FIG. 3A.

To facilitate the bi-directional and omni rotational movement, the pivot connector frame 110 may be inserted and secured into an infrastructure patch panel (not illustrated) using panel secure tabs 160 (illustrated in FIG. 4A).

Figure 3B:
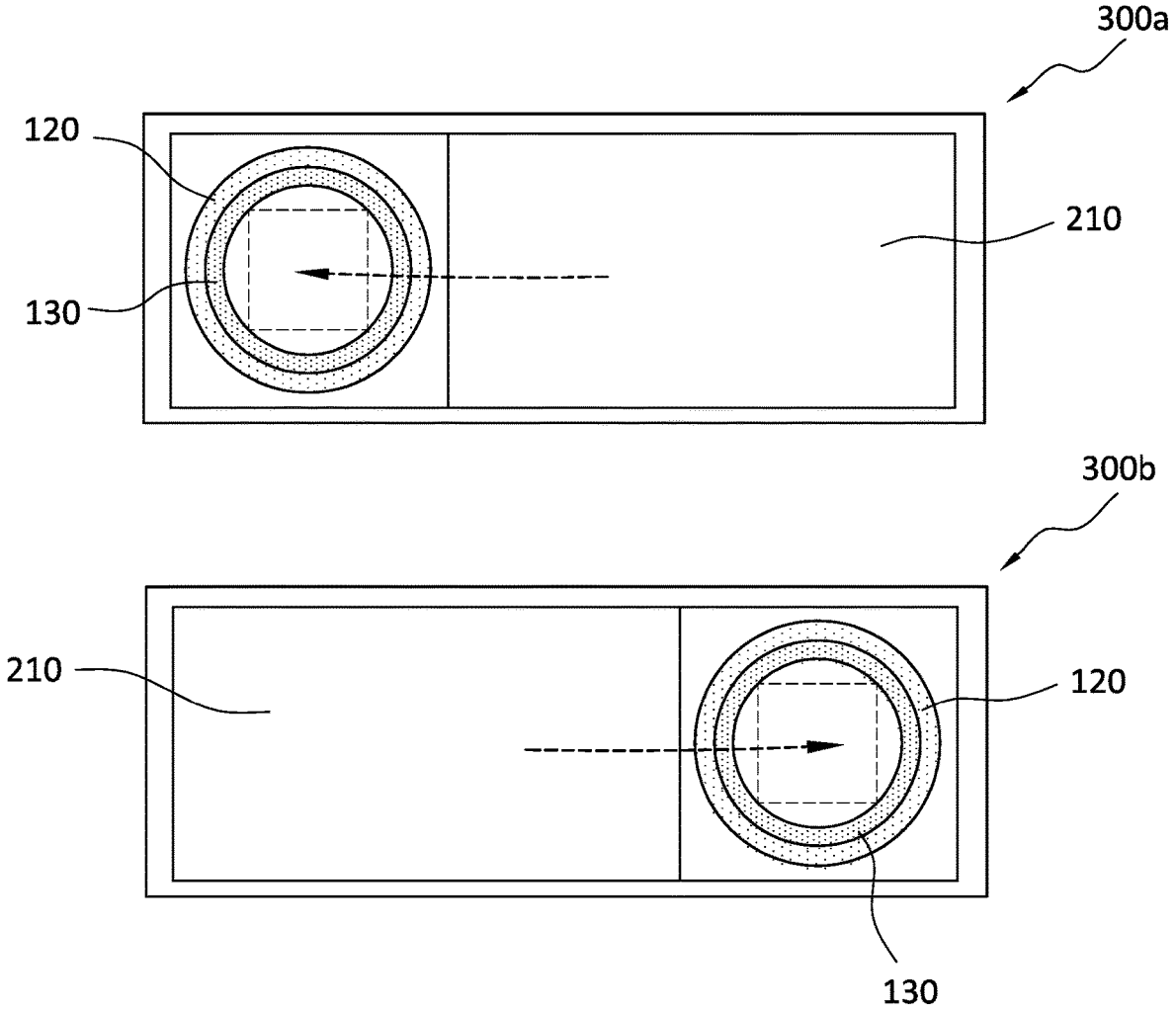
FIG. 3B illustrates sliding sheath right and left directional movements of the combination directional swivel connector adapter in accordance with FIG. 3A.
Figure 3C:
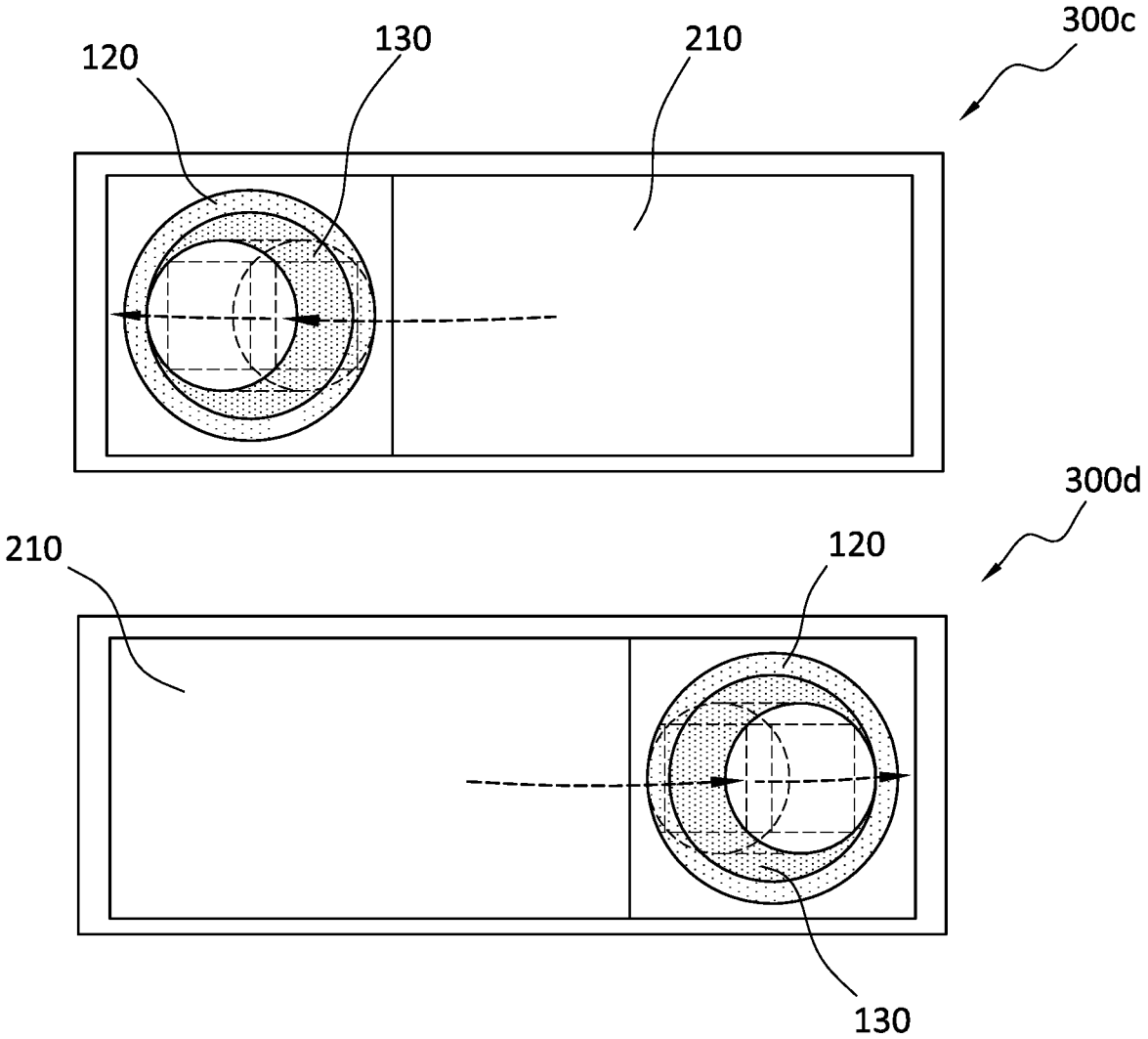
FIG. 3C illustrates left and right combined extended directional movements of the combination directional swivel connector adapter in accordance with FIG. 3A.

FIGS. 3B-3F illustrate different positional variations of the connector case 130 in combination with the sliding sheath 210. FIG. 3B illustrates sliding sheath 210 left (300*a*) and right (300*b*) directional movements of the combination directional swivel connector adapter 300 in accordance with FIG. 3A. In FIG. 3B, the connector case 130 may move with the sliding sheath 210 rotating left or right. Though the connector case 130 moves left or right, in this example the connector case 130 does not rotate within the clamping shroud 120. In FIG. 3C, the connector case 130 again may move with the sliding sheath 210 left or right, but in this case the connector case 130 may rotate within the clamping shroud 120. In such case, such as for adapter 300*c*, the connector case 130 may move as far left as the sliding sheath 210 may rotate, and then because the connector case 130 may rotate omni-directionally, the connector case 130 may rotate even farther left to accommodate a wide placement of a cable such as fiber optic cable. Similarly, for adapter 300*d*, a far right placement may be established for the connector case 130.

Figure 3D:
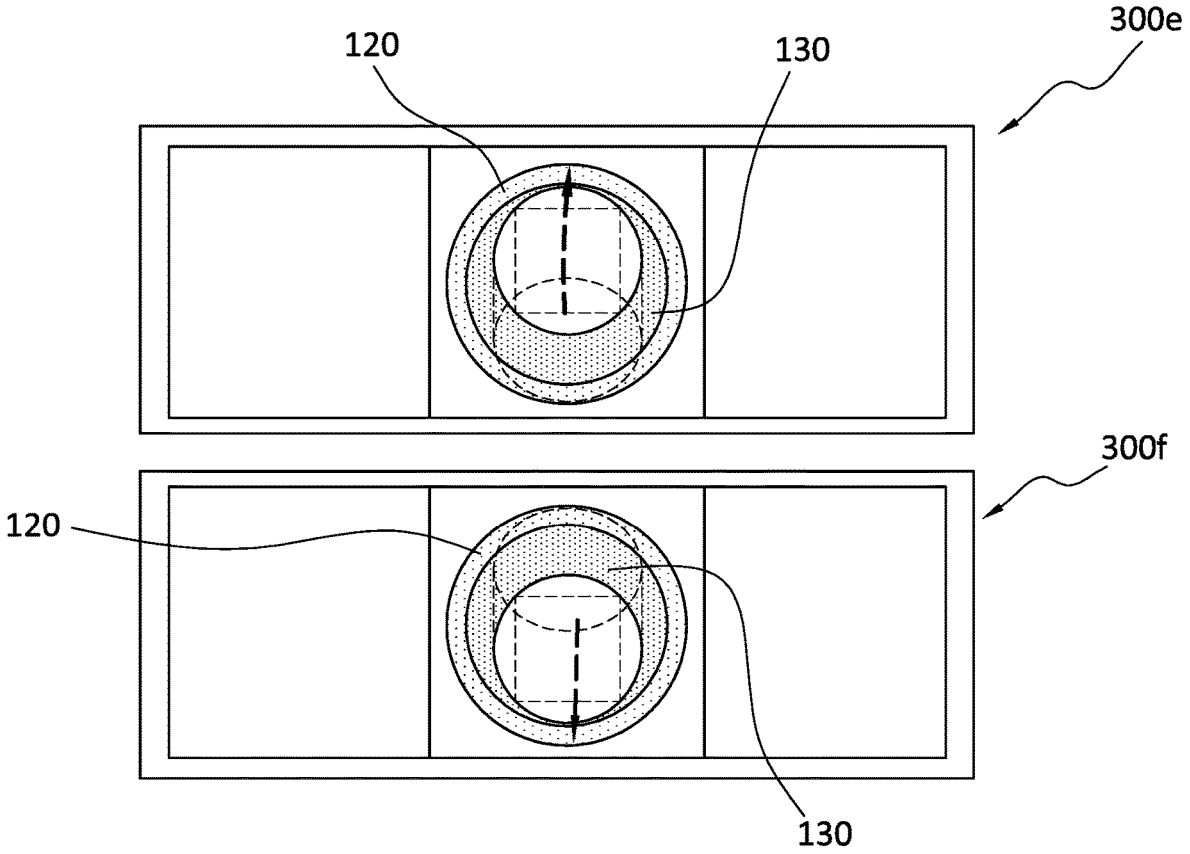
FIG. 3D illustrates up and down connector case directional movements of the combination directional swivel connector adapter in accordance with FIG. 3A.

FIG. 3D illustrates up (300*e*) and down (300*f*) connector case 130 directional movements of the combination directional swivel connector adapter 300 in accordance with FIG. 3A.

Figure 3E:
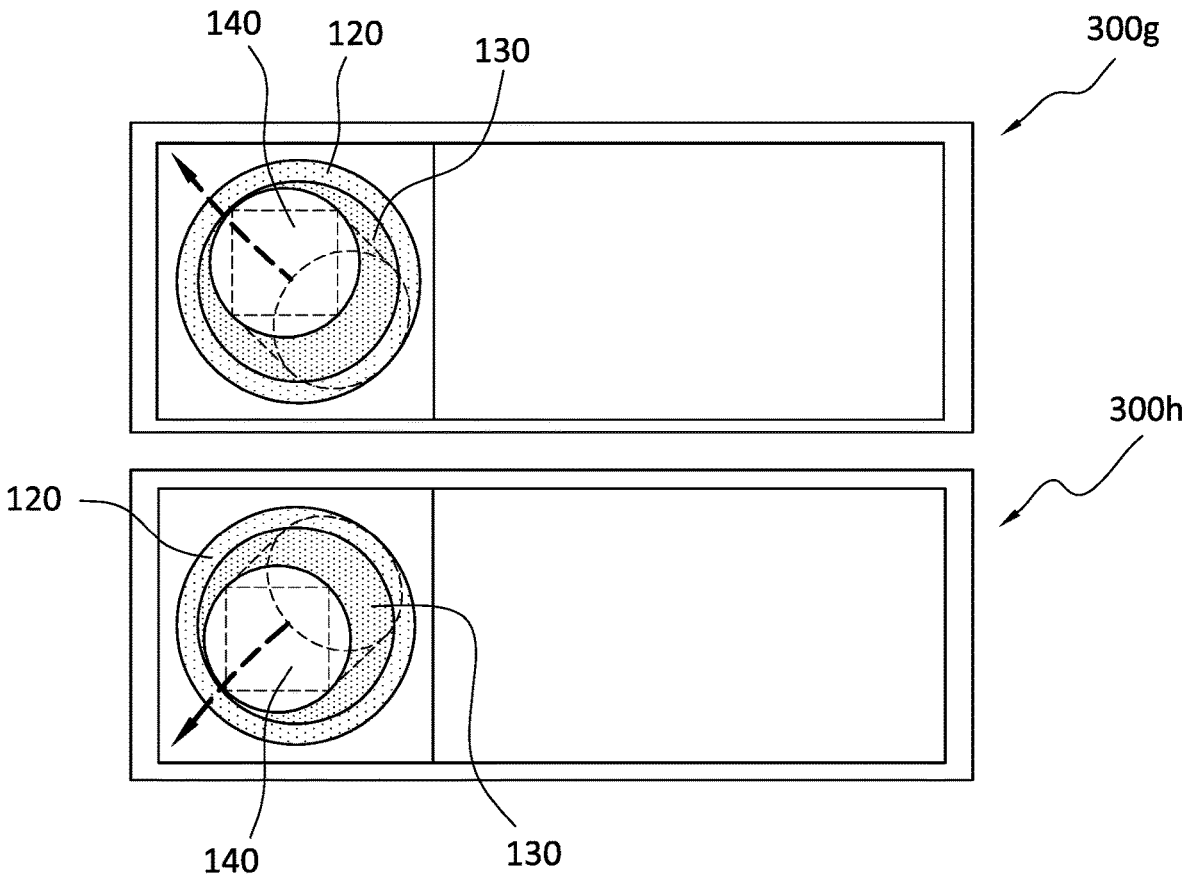
FIG. 3E illustrates left-up and left-down combined extended directional movements of the combination directional swivel connector adapter in accordance with FIG. 3A.

FIG. 3E illustrates left-up (300*g*) and left-down (300*h*) combined extended directional movements of the combination directional swivel connector adapter 300 in accordance with FIG. 3A. Similar to the example embodiment of FIG. 3C, a left-most position may be reached for the connector case 130, coupled with an uppermost and lowermost capability. All the configurations described herein provide for a high degree of flexibility, movement, and placement of cables within the bulkhead adapter cavity 140 of the connector case 130.

Figure 3F:
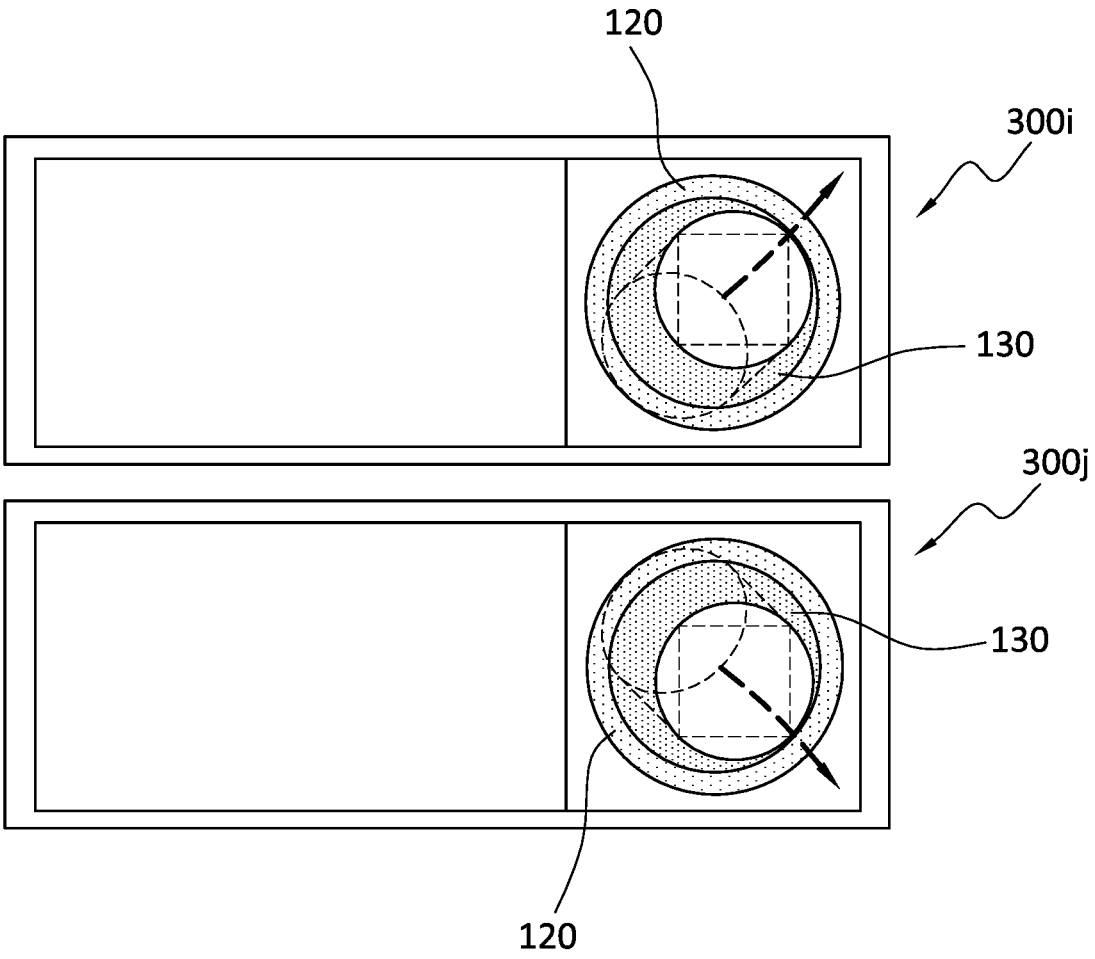
FIG. 3F illustrates right-up and right-down combined extended directional movements of the combination directional swivel connector adapter in accordance with FIG. 3A.

FIG. 3F illustrates right-up (300*i*) and right-down (300*j*) combined extended directional movements of the combination directional swivel connector adapter 300 in accordance with FIG. 3A. Example embodiments are similar to those of FIG. 3E, with rotational movements and extensions possible to a right-most, uppermost and lowermost capabilities for cable connection and flexibility.

FIG. 4A illustrates top views of left, center, and right sliding sheath 210 directional movements of the combination directional swivel connector adapter 300 in accordance with FIG. 3A. As illustrated, the connector case 130 may rotate left with the sliding sheath 210, while the bulkhead adapter cavity 140 within the connector case 130 does not move. Tabs 460 may be used so secure the clamping shroud 120 to the sliding sheath 210.

Figure 4B:
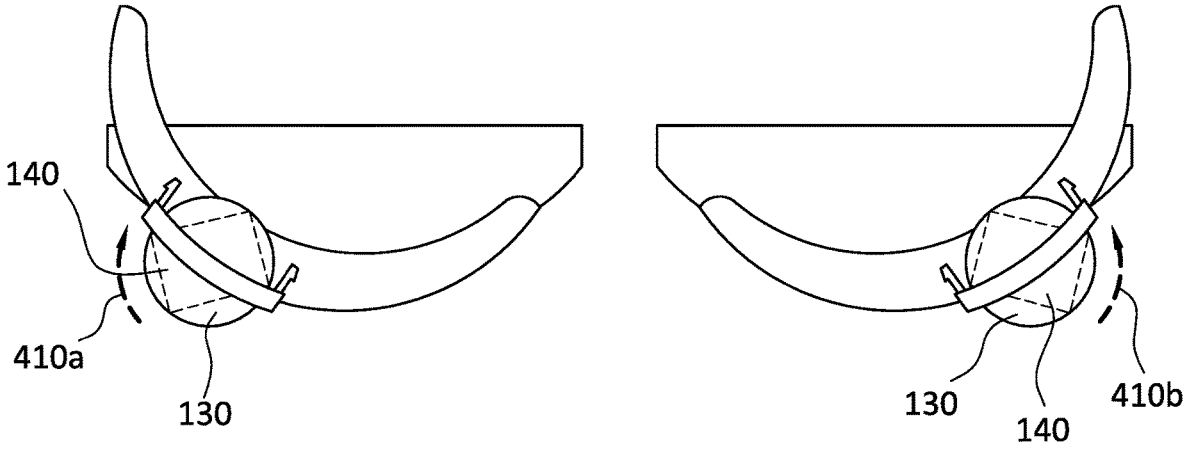
FIG. 4B illustrates top views of left and right combined extended directional movements of the combination directional swivel connector adapter in accordance with FIG. 3A.

FIG. 4B illustrates top views of left and right combined extended directional movements of the combination directional swivel connector adapter in accordance with FIG. 3A. In FIG. 4B, from a far left or far right position, the connector case 130 is rotated even farther so that the bulkhead adapter cavities 140 may provide a widest extension possibility for cable connections. The wide extension for the bulkhead adapter cavity 140 on the left side is indicated by extension arrow 410*a*. Extension arrow 410*b* indicates the rotational movement of the bulkhead adapter cavity 140 within the connector case 130.

Figure 4C:
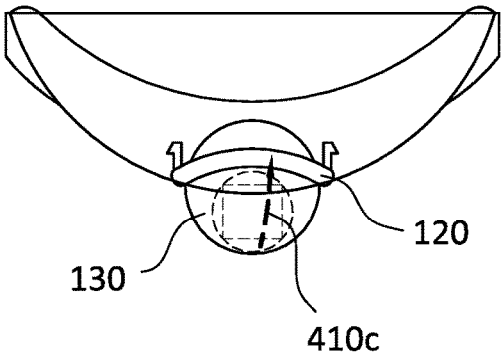
FIG. 4C illustrates a top view of an upward position connector case directional movement of the combination directional swivel connector adapter in accordance with FIG. 3A.
Figure 4D:
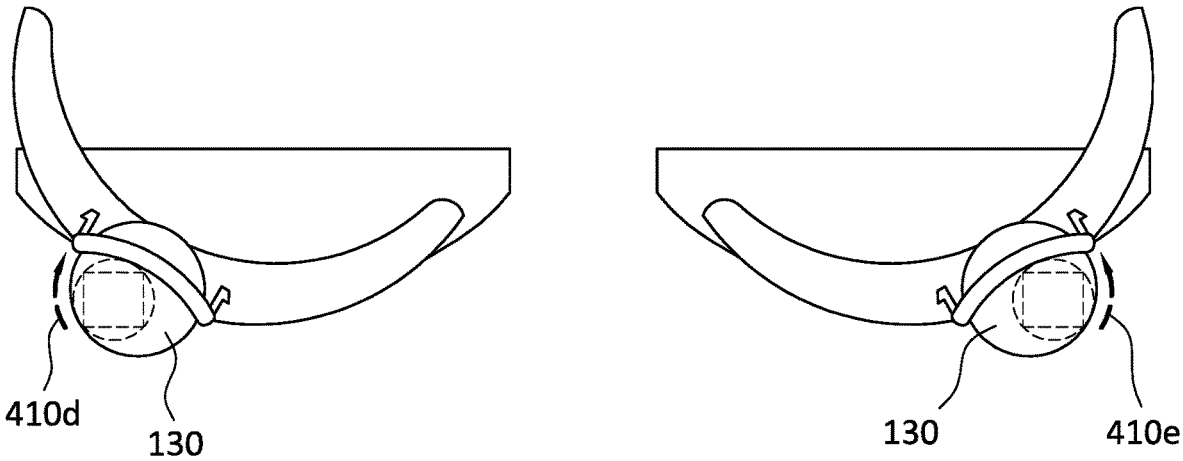
FIG. 4D illustrates top views of left-up and right-up combined extended directional movement of the combination directional swivel connector adapter in accordance with FIG. 3A.

FIG. 4C illustrates a top view of an upward position connector case 130 directional movement of the combination directional swivel connector adapter 300 in accordance with FIG. 3A. The upward position of the connector case 130 is illustrated by the arrow 410*c*. FIG. 4D illustrates top views of left-up (arrow 410*d*) and right-up (arrow 410*e*) combined extended directional movement of the combination directional swivel connector adapter in accordance with FIG. 3A.

Example embodiments provide flexibility and adjustability at the connector junction point of a bulkhead connector 135, and the bulkhead adapter cavity 140. The omni-directional swivel connector adapter 100 and connector case 130 allows for motion at the cable connector junction within an infrastructure patch panel, providing more flexibility and a higher degree of cable bend angle.

Example embodiments include significant reduction in cable bend strain and the possibility of connectivity degradation or failure. The flexibility and movement provided at the cable connection junction may dramatically reduce connectivity degradation or failure due to cable bend strain or by buffering impacts at the cable bend point, which can occur at the furnication or boot.

Example embodiments may increase cabling performance and efficiency. The variety of different cable bend movements, angles and articulations may help meet or exceed certain physical cable installation requirements in addition to providing new opportunities to develop cabling infrastructure support systems that utilize space more efficiently.

Example embodiments provide possibilities for various types of infrastructure panels suited for more compact installation environments. The flexibility and movement of the cable bend with its efficiencies to cable dressing and installation may also support development of new types and sizes of infrastructure patch panels, network interface cards and transceivers all of which may increase connectivity performance and reduce space utilization.

Example embodiments also provide support of all cable multimedia and connector types. The adapter design may support a variety of existing and future cable connector bulkheads and high performance connectivity specifications.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

The invention claimed is:

1. A connector adapter, comprising:

a pivot connector frame;

a clamping shroud configured to fit through the pivot connector frame in a first direction;

a connector case disposed within the clamping shroud;

a sliding sheath to which the connector case is connected; and a bulkhead adapter cavity formed within the connector case, wherein the connector case is configured for rotatable movement and slidable movement in a second direction within the sliding sheath.

2. The connector adapter of claim 1, wherein the connector case rotates within the clamping shroud.

3. The connector adapter of claim 1, wherein the rotatable movement is omni-directional movement.

4. The connector adapter of claim 1, wherein the sliding sheath is configured to move bi-directionally within the pivot connector frame.

5. The connector adapter of claim 4, wherein the sliding sheath has stoppers at ends thereof to prevent over rotation of the sliding sheath.

6. The connector adapter of claim 4, wherein the sliding sheath is arc-shaped.

7. The connector adapter of claim 4, wherein the sliding sheath houses a plurality of connector cases.

8. The connector adapter of claim 1, wherein the rotatable movement and slidable movement are independent of each other.

9. A connector adapter, comprising:

a connector frame;

a sliding sheath movable in two directions about the connector frame;

a connector case mounted within the sliding sheath and extending through the connector frame, wherein the connector case is configured for rotatable movement and slidable movement in a second direction within the sliding sheath; and a bulkhead adapter cavity formed within the connector case, the bulkhead adapter cavity configured to receive a connector and cable, wherein the bulkhead adapter cavity is configured to move in at least two directions within the sliding sheath.

10. The connector adapter of claim 9, wherein one direction of the at least two directions is bi-directional and a second direction of the at least two directions is rotatable.

11. The connector adapter of claim 10, wherein the second direction is omni-directional.

12. The connector adapter of claim 9, wherein the sliding sheath includes stoppers to limit and prevent over rotation of the sliding sheath.

13. The connector adapter of claim 9, wherein the sliding sheath is arc-shaped.

14. The connector adapter of claim 9, comprising a shroud to protect the connector case.

15. The connector adapter of claim 14, wherein the connector frame has two sides and the shroud extends from either side to protect the connector case.

16. The connector adapter of claim 15, wherein the shroud is adjustable and configured to tighten or loosen a motion cadence of the connector case.

17. The connector adapter of claim 9, wherein the connector frame includes panel secure tabs configured to attach to a panel.

18. The connector adapter of claim 9, wherein the connector case has an open end to receive the connector and cable and a closed end opposite the open end.

19. The connector adapter of claim 18, wherein the closed end is rounded.

* * * * *